US005230115A

United States Patent [19]

Hollister et al.

[11] Patent Number: 5,230,115

[45] Date of Patent: Jul. 27, 1993

[54] TENNIS SHOE ACCESSORY FOR CLEANING

[76] Inventors: Jimmy J. Hollister, P.O. Box 2278, Big Bear City, Calif. 92314; Ronald T. Pettyjohn, P.O. Box 202, Creston, Calif. 93432

[21] Appl. No.: 867,387

[22] Filed: Apr. 13, 1992

[51] Int. Cl.[5] ..... A43D 3/00

[52] U.S. Cl. ..... 12/128 B; 12/115.6; 206/77.1

[58] Field of Search ..... 12/114.2, 115.6, 117.4, 12/128 R, 128 B, 133 A, 133 M, 135 A, 115.8; 206/77.1, 0.5; 68/17 R

[56] References Cited

U.S. PATENT DOCUMENTS

| | | | |
|---|---|---|---|
| 549,831 | 11/1895 | Steuer | 206/77.1 |
| 662,807 | 11/1900 | Niles | 12/115.6 |
| 1,119,744 | 12/1914 | Bowen | 12/115.8 |
| 2,275,072 | 3/1942 | Bradshaw | 12/115.6 |
| 2,446,904 | 8/1948 | Brush | 12/128 B |
| 2,460,405 | 2/1949 | Abrams et al. | 12/128 B |
| 2,510,315 | 6/1950 | Malberg | 12/128 B |
| 2,841,590 | 3/1961 | McKnight | 206/77.1 |
| 3,899,073 | 8/1975 | Barr | 206/77.1 |
| 3,979,786 | 9/1976 | Vierra et al. | 12/128 B |
| 4,497,080 | 2/1985 | Inspector | 12/128 R |

FOREIGN PATENT DOCUMENTS

| | | | |
|---|---|---|---|
| 290332 | 11/1988 | European Pat. Off. | 68/17 R |

*Primary Examiner*—Steven N. Meyers
*Assistant Examiner*—Thomas P. Hilliard
*Attorney, Agent, or Firm*—Roger A. Marrs

[57] ABSTRACT

A tennis shoe weighted device is disclosed herein for insertion into a tennis shoe during a washing procedure which includes a weighted body having a soap carrying compartment on one side and a resiliently mounted telescoping rod outwardly projecting from the other body side. The soap compartment is provided with an access opening for introducing soap into the compartment and a multiplicity of apertures for selectively releasing soap into surrounding wash water. A weight in the body is critically located on the soap compartment side of the device so that the device is unevenly weighted along its central longitudinal axis.

1 Claim, 1 Drawing Sheet

FIG. 1.
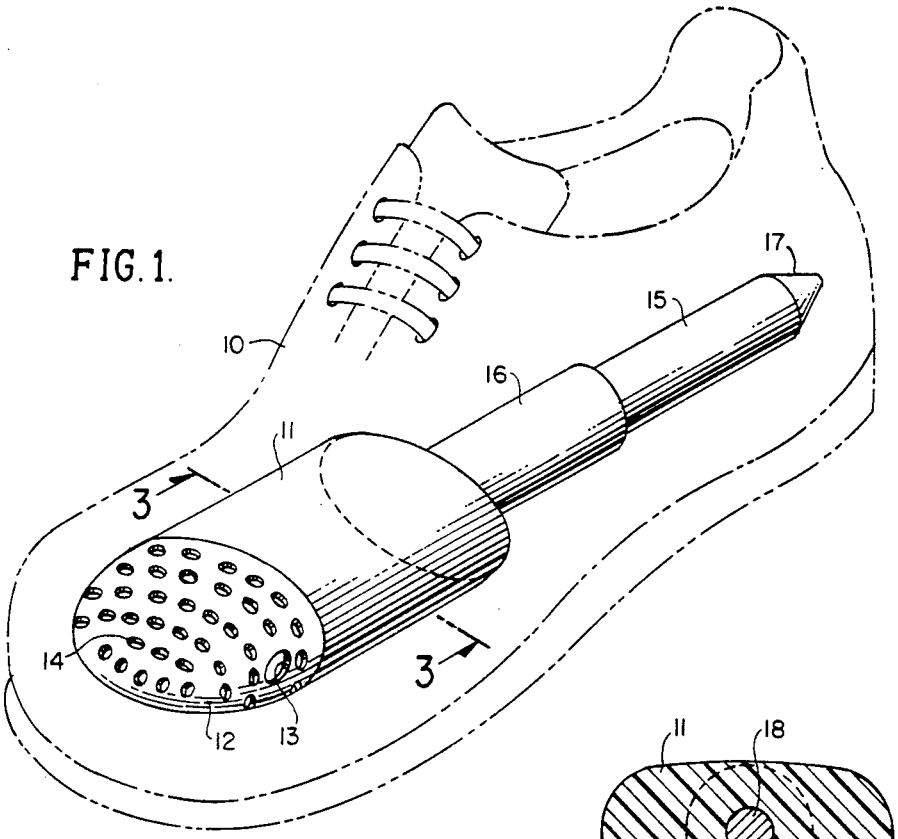
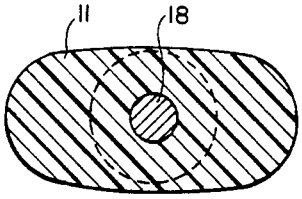
FIG. 3.
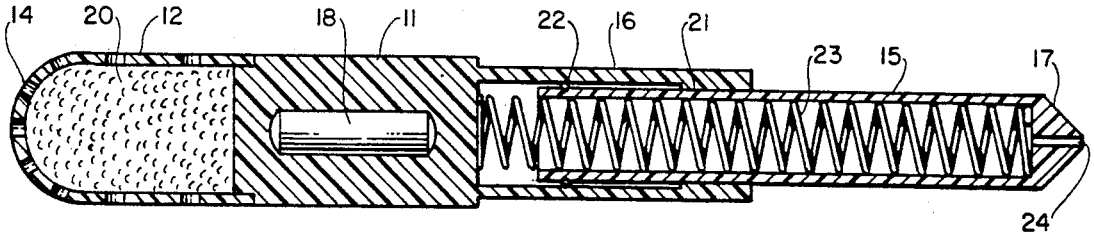
FIG. 2.

TENNIS SHOE ACCESSORY FOR CLEANING

BACKGROUND OF THE INVENTION

1. Field of the Invention

The present invention relates to the field of shoe-cleaning devices, and more particularly to a novel weighted device which is fitted into a tennis shoe so that the shoe will sink into wash water to reach the agitating area during a washing procedure.

2. Brief Description of the Prior Art

In the past, it has been the conventional practice to clean or wash tennis shoes by placing them in a conventional washing machine of the agitator type. When using such a washing machine, the machine employs a powered agitator which churns the wash water and circulates the clothes, shoes or other materials intended to be cleaned. However, problems and difficulties have been encountered when attempting to wash tennis shoes, which stem largely from the fact that the shoe is light in weight and has a tendency to float on the top of the wash water at a substantial distance away from the agitating area. Because of this characteristic of tennis shoes, the shoe is seldom thoroughly cleaned and the washing procedure must be done by hand rather than through the use of an automatic machine.

Therefore, a long-standing need has existed to provide a novel means by which the tennis shoe can be introduced and maintained in the agitating area of the wash water during a washing cycle or procedure. Such a device must not restrict the washing procedure and must ensure that all the areas of the shoe are washed and cleaned during the washing procedure.

SUMMARY OF THE INVENTION

Accordingly, the above problems and difficulties are obviated by the present invention which provides a novel tennis shoe device for weighting the device so that when inserted into the interior of a tennis shoe, the weighted shoe will be submerged into wash water and maintained in the agitation section or area thereof during a washing or cleaning procedure. The weighted device includes a main body which integrally supports a weighted member or mass. A compartment containing soap particles is carried on one side of the main body, while a resiliently extendable rod is carried in a telescoping fashion on the other side of the body. The soap compartment includes an access opening for introducing soap into the interior thereof and a plurality of apertures so that the soap is selectively released during the washing procedure when submerged in water. The extendable rod is preferably spring-mounted and includes an air relief orifice so that the rod may be easily removed through a supporting tube carried on the side of the main body.

A feature resides in the provision of the weighted mass on one side of center of the device so that once the device is installed in the shoe, the shoe will present its central longitudinal axis in a vertical direction.

Therefore, it is among the primary objects of the present invention to provide a novel inexpensive and easily installed weighted device into a tennis shoe so that the shoe is submerged into the agitation area of water during a washing cycle.

Another object of the present invention is to provide a novel means by which a tennis shoe may be introduced into the agitation area of wash water and which will orient the shoe in such a manner that it will have a tendency to spin or rotate about its central longitudinal axis in a vertical direction.

Still another object of the present invention is to provide a weighted device for removable insertion into the interior of a tennis shoe and which will fit various sizes of shoe whereby the tennis shoe will be encouraged to enter the agitation area of wash water toe-down.

Yet another object of the present invention is to provide a novel device for assisting in the washing or cleansing of a tennis shoe which includes a weighted mass supporting a soap compartment on one side and an extendable or adjustable rod on its other side so that the device may be readily introduced into the interior of the shoe and whereby the shoe will be oriented toe-down in the wash water during the washing procedure.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

FIG. 1 is a front perspective view of the novel tennis shoe accessory for cleaning or washing shoes incorporating the present invention;

FIG. 2 is a longitudinal sectional view of the device shown in FIG. 1; and FIG. 3 is a transverse cross-sectional view of the device shown in FIG. 1 as taken in the direction of arrows 3—3 thereof.

DESCRIPTION OF THE PREFERRED EMBODIMENT

Referring to FIG. 1, a conventional tennis shoe is indicated by numeral 10 and it is to be understood that the shoe is lightweight as compared to leather shoes, boots or the like. Furthermore, as is the usual practice, a tennis shoe is composed of canvass, nylon cloth, composition, sole material and the like. These materials become dirty easily and it is difficult to cleanse and wash the fabric or other materials used in the production of the shoe. Particularly during, a washing procedure in an automatic washing machine, the lightweight shoe has a tendency to float on the surface of the wash water and, therefore, does not approach nor enter the agitation area where the cleansing process generally takes place. The device of the present invention encourages the tennis shoe to enter the agitation area in a toe-down orientation so that it will have a tendency to rotate about its central longitudinal axis.

FIG. 1 discloses the weighted device for achieving the above purpose by including a weighted body 11 having opposite sides. One side is employed for carrying the soap compartment 12 of hollow interior and which includes an access opening 13 through which soap can be introduced into the compartment. A plurality of apertures, such as aperture 14, is employed for selectively releasing the soap from the interior of the compartment into surrounding wash water during the washing procedure. The soap compartment 12 is configured in a substantially rounded or oval configuration so as to fit into the toe portion of the shoe interior during use without placing undue stress on any of the shoe components, such as fabric, cloth or the like.

The weighted device of the present invention is adapted to be inserted into a variety of different sized tennis shoes by means of an adjustment rod 15 which is resiliently carried within a tube 16 carried on the side of the weighted body 11 opposite to its side carrying the soap compartment 12. A tapered or conical tip 17 carried on the end of rod 15 is intended to bear against the inside of the heel of the tennis shoe when the weighted device is installed.

Referring now in detail to FIG. 2, it can be seen that the weighted body 11 includes a weight or mass 18 which is centrally located within the body 11 to one side of center of the device. Preferably, the mass 18 is elongated so that its weight will have a tendency to tip the device and the shoe in which it is installed forward so that the toe of the shoe will point downwardly in the wash water during the washing procedure. Soap in the compartment 12 is indicated by numeral 20 and is preferably of the granulated type so that it will readily dissolve and pass through the apertures 14 during the washing procedure when immersed in the water. FIG. 2 further illustrates that the tube 16 is fixedly secured to the side of body 11 and that it includes a reduced portion 21 presenting an internal shoulder for serving as a stop for the rod 15 when snap-ring 22 engages with the shoulder 21. An expansion spring 23 bears against the side of body 11 at one end and bears against the tip 17 at its other end so that the rod 15 is normally biased out of the tube 16. In this manner, the device is resiliently held in position within the cavity of the shoe interior with the soap compartment 12 in the toe portion of the shoe while the tip 17 bears against the inside of the shoe heel. An air relief orifice is indicated by numeral 24 and is provided to conduct air from the interior of the tube 18 during rectilinear movement of the rod 15.

As shown in FIG. 3, the weighted mass 18 is substantially in the center of the body 11 and the body includes a rounded exterior so as to substantially conform with the toe of the tennis shoe when installed.

In view of the foregoing, it can be seen that the weight device of the present invention provides a practical means for weighting a lightweight tennis shoe in such a manner that it will not float on the surface of wash water but will sink into the agitation area of the washing machine. By use of the adjustment rod 15, the device may be fitted into any one of various sized tennis shoes and by including a quantity of soap 20 in the soap compartment 12, thorough cleansing of the shoe interior is assured. After the washing procedure, the device may be removed from the shoe and used repeatedly for subsequent washing procedures.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A weight device for insertion into a lightweight tennis shoe having a toe and heel separated by an interior cavity comprising the combination of:

a main body having opposite sides;

a soap compartment carried on one side of said body;

a resiliently mounted extension rod mounted on the other side of said body;

a weighted mass secured to said main body between said soap compartment and said extension rod;

a quantity of soap carried within said soap compartment;

said compartment having an access opening for introducing said soap into said compartment;

a tube cantilevered outwardly from said main body terminating in a reduced bore;

said extension rod slideably carried within said tube;

an expansion spring disposed in said tube bearing at one end with said main body and against said rod at its opposite end normally urging said rod away from said tube;

stop means carried on said rod operative with said tube reduced bore to maintain said rod in sliding relationship with said tube;

said soap compartment adapted to be inserted into said tennis shoe cavity for disposition immediately adjacent to said tennis shoe toe;

said extension rod adapted to bear against said tennis shoe heel; and said weighted mass in close proximity to said tennis shoe toe so as to result in toe-down position when said tennis shoe is submerged in water.

* * * * *